US010226119B1

(12) United States Patent
Ko

(10) Patent No.: US 10,226,119 B1
(45) Date of Patent: Mar. 12, 2019

(54) TABLETOP ELEVATION ADJUSTMENT MECHANISM

(71) Applicant: Wen-Shan Ko, Changhua County (TW)

(72) Inventor: Wen-Shan Ko, Changhua County (TW)

( * ) Notice: Subject to any disclaimer, the term of this patent is extended or adjusted under 35 U.S.C. 154(b) by 0 days.

(21) Appl. No.: 15/863,283

(22) Filed: Jan. 5, 2018

(51) Int. Cl.
*A47B 9/20* (2006.01)

(52) U.S. Cl.
CPC ..... *A47B 9/20* (2013.01)

(58) Field of Classification Search
CPC A47B 9/20; A61G 13/06; E04H 12/18; F16B 7/10; F16M 11/26; F16M 11/28
USPC ..... 248/188.5, 132, 161, 414; 384/37, 17, 384/10, 38, 42, 20, 26; 212/350; 403/109.1; 267/158, 164–165
See application file for complete search history.

(56) References Cited

U.S. PATENT DOCUMENTS 1,917,926 A * 7/1933 Decker ..... B23Q 1/262 267/165
9,751,550 B2 * 9/2017 Crowley ..... B62B 3/0612
2012/0043436 A1 * 2/2012 Atkinson ..... A47B 9/20 248/188.5
2013/0221171 A1 * 8/2013 Lorenzen ..... A47B 9/20 248/188.5
2017/0341669 A1 * 11/2017 Crowley ..... B62B 3/0612

* cited by examiner

*Primary Examiner* — Christopher Garft
(74) *Attorney, Agent, or Firm* — Muncy, Geissler, Olds & Lowe, P.C.

(57) ABSTRACT

A tabletop elevation adjustment mechanism includes a fixed outer tube, a movable inner tube vertically movable in the fixed outer tube, and a plurality of corrugated sheet members equiangularly fastened to a bottom of the movable inner tube. Each of the corrugated sheet members has a plurality of first and second ridge portions respectively protruding toward two opposite sides thereof. The first ridge portions elastically stopped against an outer surface of the movable inner tube and the second ridge portions elastically stopped against an inner surface of the fixed outer tube.

3 Claims, 4 Drawing Sheets

TABLETOP ELEVATION ADJUSTMENT MECHANISM

BACKGROUND OF THE INVENTION

1. Field of the Invention

The present invention relates to height-adjustable table technology, and more particularly to a tabletop elevation adjustment mechanism, which can solve the problem of gap caused by size tolerance.

2. Description of the Related Art

In order to meet the needs of different users on the desktop height, commonly used reading tables, computer tables or office desks, are normally equipped with an elevation adjustment mechanism for allowing users to adjust the desktop height as desired. Referring to conventional tabletop elevation adjustment mechanism, it generally comprises a fixed outer tube and a movable inner tube movably inserted in the fixed outer tube movable. By means of adjusting the elevation of the movable inner tube relative to the fixed outer tube, the tabletop elevation is thus adjusted.

In order to reduce friction between the fixed outer tube and the movable inner tube, a bushing is employed to sleeve onto a top opening of the fixed outer tube to accommodate the movable inner tube, smoothening the vertical moving of the movable inner tube relative to the fixed outer tube and avoiding generation of noises. However, the size of the bushing is predetermined. If the movable inner tube has a significant size tolerance, the bushing will be unable to fit the movable inner tube, causing the movable inner tube unable to be used. Further, owing that the bushing is installed on the top opening of the fixed outer tube, the movable inner tube will be rubbed against the bushing, causing axial scratch on the surface of the movable inner tube after long term uses. Thus, this related art design still has room for improvement.

SUMMARY OF THE INVENTION

The present invention has been accomplished under the circumstances in view. It is the main object of the present to provide a tabletop elevation adjustment mechanism, which can solve the problem of gap caused by size tolerance, and can reduce friction wear during the operation.

To achieve this and other objects of the present invention, a tabletop elevation adjustment mechanism of the present invention is provided, which comprises a fixed outer tube, a movable inner tube, and a plurality of corrugated sheet members. The movable inner tube has a bottom and an axis. The movable inner tube is movably inserted in the fixed outer tube, having a top end thereof disposed outside the fixed outer tube and an opposing bottom end thereof disposed inside the fixed outer tube. The corrugated sheet members are fastened to the bottom of the movable inner tube and equiangularly arranged around the axis of the movable inner tube. Each of the corrugated sheet members comprises a plurality of first ridge portions and second ridge portions respectively protruding toward two opposite sides thereof. The first ridge portions are elastically stopped against an outer surface of the movable inner tube. The second ridge portions are elastically stopped against an inner surface of the fixed outer tube.

Thus, the tabletop elevation adjustment mechanism of the present invention can use the corrugated sheet members to fill up the gap between the fixed outer tube and the movable inner tube. Even there exists a size tolerance between the fixed outer tube and the movable inner tube, the corrugated sheet members can be properly and elastically deformed to compensate the size tolerance. Further, since the corrugated sheet members are mounted on the outer surface of the movable inner tube, the surface friction wear caused on the movable inner tube can be reduced by the corrugated sheet members as the movable inner tube vertically moves.

Preferably, the movable inner tube comprises a plurality of upper elongated holes and a plurality of lower elongated holes disposed at the bottom of the movable inner tube. The upper elongated holes each have a longitudinal axis parallel to the axis of the movable inner tube. The lower elongated holes each have a longitudinal axis perpendicular to the axis of the movable inner tube. Further, each of the corrugated sheet members comprise an upper locating rod a lower locating rod respectively inserted into one of the upper elongated holes and one respective lower elongated hole of the movable inner tube. The mating design of the upper and lower elongated holes of the movable inner tube and the upper and lower locating rods of the corrugated sheet members can facilitate quick installation of the corrugated sheet members.

Preferably, the corrugated sheet members each have a rectangular shape and have a center opening cut through the two opposite sides thereof. The center opening has a long side parallel to the axis of the movable inner tube. Thus, the corrugated sheet members can be easily and elastically deformed when it receives an external force.

Other advantages and features of the present invention will be fully understood by reference to the following specification in conjunction with the accompanying drawings, in which like reference signs denote like components of structure.

DETAILED DESCRIPTION OF THE INVENTION

The invention will now be described by way of examples with reference to the annexed drawings. In the specification, the terms "up", "down", "inside", "outside", "top", "bottom" and so on are merely descriptive terms based on the normal use direction but not intended to limit the scope of the invention.

Figure 1:
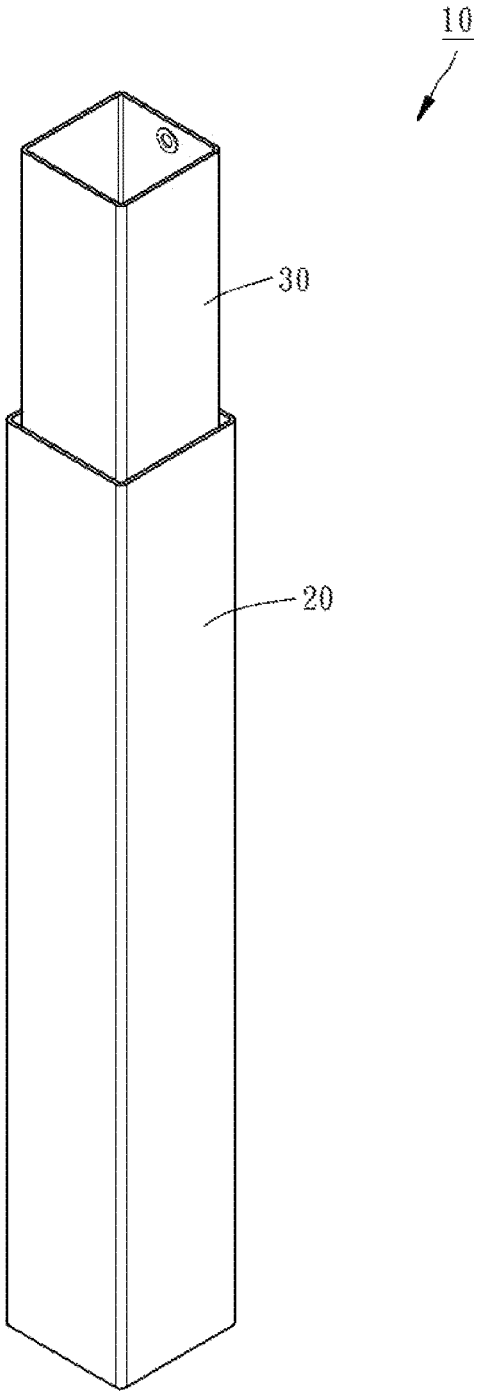
FIG. 1 is an oblique top elevational view of a tabletop elevation adjustment mechanism in accordance with the present invention.

Referring to FIG. 1, a tabletop elevation adjustment mechanism 10 of the present invention comprises a fixed outer tube 20, a movable inner tube 30, and four corrugated sheet members 40.

The fixed outer tube 20 in this embodiment has a rectangular cross section.

The movable inner tube 30 in this embodiment has a rectangular cross section. The movable inner tube 30 has a bottom 31 and an axis S1. The movable inner tube 30 is vertically and movably inserted in the fixed outer tube 20. The movable inner tube 30 has a top end thereof disposed outside the fixed outer tube 20 and an opposing bottom end disposed inside the fixed outer tube 20. Further, the movable inner tube 30 has an upper elongated hole 32 and two juxtaposed lower elongated holes 34 located on each of four sides thereof at the bottom 31 of the movable inner tube 30. The two lower elongated holes 34 are arranged in parallel. The upper elongated hole 32 has a longitudinal axis S2 parallel to the axis S1 of the movable inner tube 30. The lower elongated holes each 34 have a longitudinal axis S3 perpendicular to the axis S1 of the movable inner tube 30.

Figure 3:
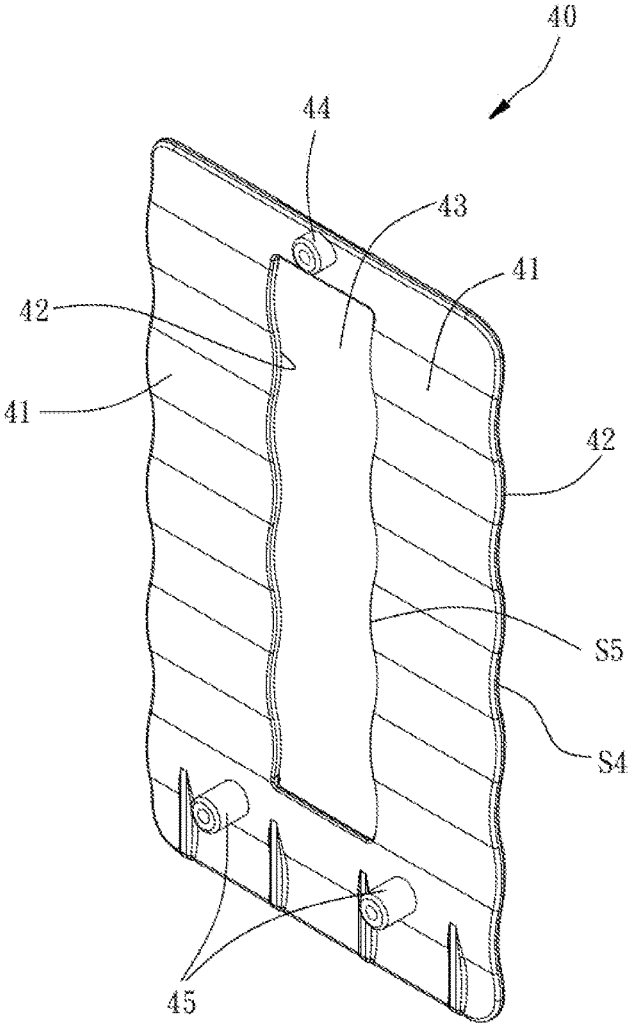
FIG. 3 is an elevational view of a corrugated sheet member for tabletop elevation adjustment mechanism in accordance with the present invention.

The corrugated sheet members 40 are flexible rectangular plastic sheets with a long side S4 parallel to the axis S1 of the movable inner tube 30. As illustrated in FIG. 3, each of the corrugated sheet members 40 comprise a plurality of first ridge portions 41 and second ridge portions 42 protruding toward two opposite sides thereof and alternatively arranged in two rows along the axis S1 of the movable inner tube 30, i.e., each of the first ridge portions 41 is connected between two of the adjacent second ridge portions 42. Further, the corrugated sheet members 40 has a center opening 43 cut through the two opposite sides with a long side S5 parallel to the axis S1 of the movable inner tube 30. The center opening 43 enables the corrugated sheet member 40 to be easily elastically deformed when it is compressed or stretched, and facilitates equal and stable distribution of the applied force in all directions.

Figure 2:
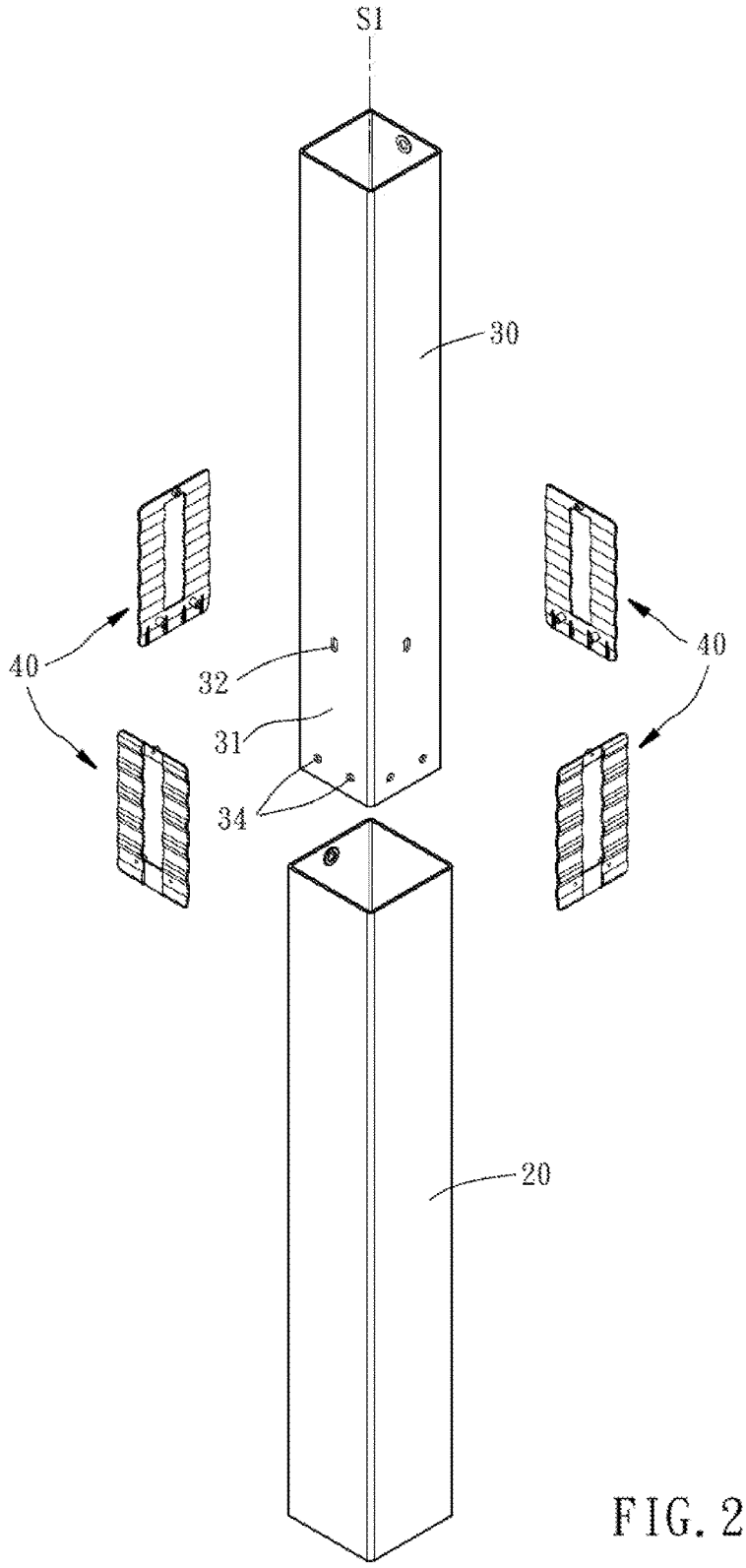
FIG. 2 is an exploded view of the tabletop elevation adjustment mechanism in accordance with the present invention.
Figure 4:
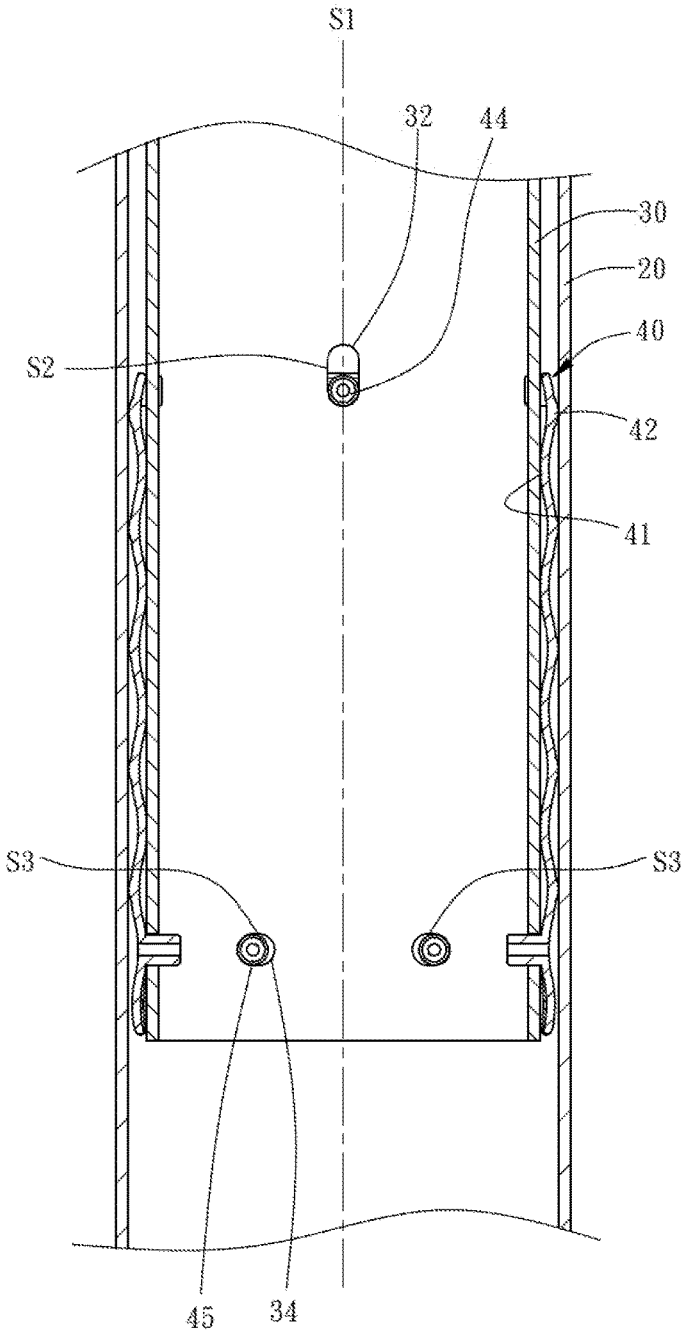
FIG. 4 is a longitudinal sectional view of the tabletop elevation adjustment mechanism in accordance with the present invention.

Referring to FIG. 2 and FIG. 4, the four corrugated sheet members 40 are respectively attached onto four lateral surfaces of the movable inner tube 30. The four corrugated sheet members 40 each further comprises an upper locating rod 44 and two juxtaposed lower locating rods 45. In installation, the upper locating rod 44 and lower locating rods 45 of the four corrugated sheet members 40 are respectively inserted into the upper elongated holes 32 and lower elongated holes 34 at each of the four lateral surfaces of the movable inner tube 30. The design of the upper and lower elongated holes 32,34 allows the user to install different size of the corrugated sheet members 40 (i.e. the corrugated sheet members 40 with higher or lower ridge height) at the same locating place (i.e. the location of the upper elongated holes 32 and lower elongated holes 34) facilitating installation flexibility, installation convenience and installation applicability. After installation, the four corrugated sheet members 40 are equiangularly arranged around the axis of the movable inner tube 30 with the first ridge portions 41 thereof elastically stopped against the four lateral surfaces of the movable inner tube 30 and the second ridge portions 42 thereof stopped against the inner surface of the fixed outer tube 20.

Thus, the tabletop elevation adjustment mechanism 10 of the present invention uses the corrugated sheet members 40 to fill up the gap between the fixed outer tube 20 and the movable inner tube 30. As the first and second ridge portions 41,42 of the corrugated sheet members 40 are respectively stopped against the movable inner tube 30 and the fixed outer tube 20, the corrugated sheet members 40 can be properly elastically deformed to compensate a size tolerance of the movable inner tube 30, saving the cost. Further, since the corrugated sheet members 40 are mounted on the four lateral surfaces of the movable inner tube 30 and the corrugated sheet members 40 can be moved up and down with the movable inner tube 30, the corrugated sheet members 40 reduces the friction wear of the movable inner tube 30 as the movable inner tube 30 is being moved upward or downward, also facilitating operation with less effort.

What is claimed is:

1. A tabletop elevation adjustment mechanism, comprising:

a fixed outer tube;

a movable inner tube having a bottom and an axis, said movable inner tube being movably inserted in said fixed outer tube, said movable inner tube having a top end thereof disposed outside said fixed outer tube and a bottom end thereof disposed inside said fixed outer tube; and a plurality of corrugated sheet members being fastened to said bottom of said movable inner tube and equiangularly arranged around said axis of said movable inner tube, each of said corrugated sheet members comprising a plurality of first ridge portions and a plurality of second ridge portions respectively protruding toward two opposite sides thereof, said plurality of said first ridge portions being elastically stopped against an outer surface of said movable inner tube, said plurality of said second ridge portions being elastically stopped against an inner surface of said fixed outer tube;

wherein said movable inner tube comprises a plurality of upper elongated holes and a plurality of lower elongated holes disposed at said bottom of said movable inner tube; said upper elongated holes have a longitudinal axis parallel to the axis of said movable inner tube; said lower elongated holes have a longitudinal axis perpendicular to said axis of said movable inner tube; each of said corrugated sheet members comprises an upper locating rod and a lower locating rod respectively inserted into one of said upper elongated holes of said movable inner tube and one of respective said lower elongated holes of said movable inner tube;

wherein a diameter of said upper locating rod is shorter than an elongated length of said upper elongated holes; wherein a diameter of said lower locating rod is shorter than an elongated length of said lower elongated holes.

2. The tabletop elevation adjustment mechanism as claimed in claim 1, wherein each of said corrugated sheet members has a rectangular shape; each of said corrugated sheet members further comprises a center opening cutting through the two opposite sides thereof; said center opening has a long side parallel to said axis of said movable inner tube.

3. The tabletop elevation adjustment mechanism as claimed in claim 1, wherein each said corrugated sheet members has a rectangular shape; each of said corrugated sheet members has a long side parallel to said axis of said movable inner tube; said first ridge portions and said second ridge portions of said corrugated sheet members are alternatively arranged in rows along said axis of said movable inner tube.

* * * * *